US009227454B2

(12) United States Patent
Ganter

(10) Patent No.: US 9,227,454 B2
(45) Date of Patent: Jan. 5, 2016

(54) BOOK FORMING AND PRESSING MACHINE

(71) Applicant: Mueller Martini Holding AG, Hergiswil (CH)

(72) Inventor: Christian Ganter, Bieberehren (DE)

(73) Assignee: Mueller Martini Holding AG, Hergiswil (CH)

( * ) Notice: Subject to any disclaimer, the term of this patent is extended or adjusted under 35 U.S.C. 154(b) by 289 days.

(21) Appl. No.: 13/857,293

(22) Filed: Apr. 5, 2013

(65) Prior Publication Data

US 2013/0266400 A1 Oct. 10, 2013

(30) Foreign Application Priority Data

Apr. 10, 2012 (CH) ..... 496/12

(51) Int. Cl.
*B42C 13/00* (2006.01)
*B42C 5/02* (2006.01)

(52) U.S. Cl.
CPC . *B42C 5/02* (2013.01); *B42C 13/00* (2013.01); *B42C 13/003* (2013.01)

(58) Field of Classification Search
CPC ..... B42C 5/02; B42C 13/00; B42C 13/003
USPC ..... 412/22, 23, 30, 900
See application file for complete search history.

(56) References Cited

U.S. PATENT DOCUMENTS

| | | | | |
|---|---|---|---|---|
| 317,689 | A * | 5/1885 | Stone | 412/30 |
| 2008/0136158 | A1* | 6/2008 | Brommer et al. | 281/21.1 |
| 2008/0138172 | A1* | 6/2008 | Brommer et al. | 412/22 |
| 2008/0138173 | A1* | 6/2008 | Brommer et al. | 412/22 |

FOREIGN PATENT DOCUMENTS

| | | | |
|---|---|---|---|
| DE | 4422783 | A1 | 1/1996 |
| EP | 0309736 | A2 | 4/1989 |
| EP | 1942009 | A1 | 7/2008 |

OTHER PUBLICATIONS

International Search Report of CH 49632012 dated May 9, 2012 with an English translation.

* cited by examiner

*Primary Examiner* — Kyle Grabowski
(74) *Attorney, Agent, or Firm* — Venable LLP; Robert Kinberg

(57) ABSTRACT

A book forming and pressing machine includes a reshaping device to perform a shaping operation on a book block, a pressing device having a number of spaced-apart pressing plates and burn-in rails to press the book block during the shaping operation, and a loading device that includes a loading table. The loading table includes a book block back support arrangement to support the book block back during the shaping operation. The latter arrangement includes at least one pair of prism plates having shaped upper edges and arranged spaced-apart, extending parallel or quasi-parallel to each other to support a correspondingly shaped book block back during the shaping operation. The arrangement further includes at least one feed element operatively connected with each prism plate and adjustable to a position to support a differently shaped book block back in place of the shaped upper edges of the prism plates.

18 Claims, 6 Drawing Sheets

BOOK FORMING AND PRESSING MACHINE

CROSS-REFERENCE TO RELATED APPLICATION

This application claims the priority of Swiss Patent Application No. 00496/12, filed on Apr. 10, 2012, the subject matter of which is incorporated herein by reference.

BACKGROUND OF THE INVENTION

The invention relates to a book forming and pressing machine comprising a pressing device, a loading device, wherein the loading device includes a loading table and the pressing device includes a number of spaced-apart pressing plates and joint-burning rails. The loading table is equipped with a mechanism that functions to support the book block back and is operatively connected to the shaping operation.

Known book production lines successively combine a book block and a cover in a clocked operation to form a book. A book forming and pressing machine is used for one of the final production steps, for example as disclosed in the German patent document DE 4422783 A1.

The aforementioned document discloses a book forming and pressing machine which comprises a number of pressing devices with thereon arranged joint-burn-in devices, as well as a rotor that is driven intermittently around a vertical axis. The books themselves are supplied via a feed-in station into a pressing device where they are accommodated fully and are formed continuously with the aid of the burn-in rail and remain permanently in the same pressing jaw until they are removed again via the discharge station. Between the feeding in of the book blocks encased in covers and the discharge of the bound and pressed books, the rotor executes some intermittent rotational movements which are utilized as intervals for the pressing and joint burning. In the loading station, the books are divided into the two book flows via a loading rake with associated guide web, so that they are subsequently transported while supported on the side and supported by the loading rake and a counter rake from a loading table equipped with prism bars from below into the opened, stopped pressing device. The prism bars are provided for this with special inserts, designed for round or flat book backs. Format changes for books therefore require machine stops and setup times for replacing the prism plates since the complete machine is provided for safety reasons with a cover which generally has to be removed first. When changing from a flat to a rounded book block back, or when changing to an insert having different dimensions which can be used to achieve a better rounding, the machine must be powered down, the cover opened and the machine subsequently restarted.

With books having a flat or straight back, differently wide support rails are provided as individual bars for which the dimensions are adapted to the thin book format, wherein these bars are screwed immovably into the frame. These are replaced with two straight bars for the wider formats, wherein these are 2 parallel arranged plates for which the narrow longitudinal surfaces point upward once they are fully installed.

According to the prior art, at least one of the plates is installed fixedly in the frame while the second plate can be displaced with the aid of different advancing mechanisms to a defined distance parallel to the first plate. The distance between the two surfaces which point toward the outside corresponds to the book thickness. The book rests with its back on the narrow longitudinal surfaces. With a configuration of this type, thicker books always only rest with the outer region of the book block back on the bars.

SUMMARY OF THE INVENTION

It is an object of the present invention to provide a book forming and pressing machine that includes prism-shaped plates, also called prism plates, for books with rounded backs which device is also suitable to grip books with flat backs during the operation by using externally controlled elements, meaning the ones used for rounded backs and the ones used for the flat book block backs are controlled externally of the prism plates.

The ability to switch between the plates makes it possible that both pairs of prism plates can be used simultaneously and without problem for specific shapes of the book backs.

According to one embodiment of the invention there is proved a book forming and pressing machine that includes: a reshaping device to perform a shaping operation on a book block; a pressing device comprising a number of spaced-apart pressing plates and joint burning rails to press the book block during the shaping operation; a loading device comprising a loading table, the loading table including a book block back support arrangement to support the book block back during the shaping operation, the book block back support arrangement including: at least one pair of prism plates having shaped upper edges and arranged spaced-apart, extending parallel or quasi-parallel to each other to support a correspondingly shaped book block back during the shaping operation; and at least one feed element operatively connected with each prism plate and adjustable to a position to support a differently shaped book block back in place of the shaped upper edges of the prism plates.

The prism plates for books with rounded backs may be provided, for example, with a guide mechanism that permits a vertical or quasi-vertical displacement of the other elements, intended for flat book backs, so that the alternating of the system may be triggered from the outside.

In an embodiment of the invention, the book forming and pressing machine has at least one pressing device, wherein this pressing device comprises pressing plates and burn-in rails. A loading device may additionally be provided which includes a loading table on which a book block is arranged so that its back basically faces the loading table, meaning the book forming and pressing machine may operate based on a natural process flow.

The loading table itself may be provided in the area along the book block back with two horizontally arranged and spaced-apart prism plates, the vertical end surface of which is intended to support the book block. These prism plates may allow an adjustment in height of alternative feed elements, installed therein, wherein the spacing between the prism plates can be adjusted with the aid of additional devices.

According to an embodiment, an externally triggered activation of prism plates matching the shape of the book block backs and/or of feed elements, as well as the adaptation of the elements to the respective thickness of the book block may be controlled from the outside and achieved primarily through changing the spacing between the prism plates resulting in flexibility for the production of differently configured books.

The system of prism plates according to the invention is embodied such that these plates can be adjusted in horizontal or quasi-horizontal direction for changing the spacing between them. The prism plates are furthermore configured such that the changeover from one specific shape of the book block back to a different shape can basically take place without having to completely replace the prism plates required for this. In addition, the system makes it possible to change the parallel positioning of the spaced-apart prism plates if necessary.

According to an embodiment, the prism plates may be operatively connected to autonomously operating feed elements, such that the feed elements can realize an independent translational movement, at least in a vertical direction, so that these feed elements which are integrated into the prism plates may be respectively activated if a change in the processing of the book back is imminent.

According to an embodiment, a first pair of spaced-apart prism plates has horizontal or quasi-horizontal end surfaces which face the back of the book block to be processed and are embodied accordingly. With a rounded shape for the book block back, these prism plates may be embodied narrow to lip-shaped, wherein the exposed ends on facing the book back generally are in operational contact with the book back to be shaped, meaning they usually take on a support function for the book to be shaped.

The spacing between the prism plates can be changed as needed, depending on the thickness of the book to be processed, thus making it possible to always adjust an optimum position for the prism plates when processing the book block back.

Finally, each of the basic prism plates comprises respectively at least one height-adjustable feed element which is used if the shape of the book block back assigned thereto must be processed, wherein the prism plates functioning as a base in that case only have a support function, relative to the feed elements, because the operating plane for the book blocks is now provided by the feed elements added in the vertical direction.

According to an embodiment of the book forming and pressing machine, the adjustment elements responsible for adding the feed elements are arranged on the outside of the basic prism plates, thus making it possible to minimize the spacing between the prism plates.

Several adjustment elements can furthermore be arranged along the length of the prism plates, thereby allowing several feed elements to be moved at the same time into the operating plane which also has a positive effect on the book block support surface.

According to an embodiment, each feed element inserted into the prism plate may comprise an anvil-type element that is effective on the back of the prism plate, wherein the anvil-type element may be displaced forcibly with the aid of a switchable force element in one direction, here in upward direction. The force element preferably operates pneumatically or hydraulically, wherein servo motors can be used. However, a mechanical feeding is also possible without problem.

In order to initiate the return stroke of the force element, the force dynamic is designed such that the feed element returns to its starting position because of its inherent weight, wherein a double-acting force can also be provided without problem. The force element may be installed in a support which takes over the mechanical connection between the force element and the respective prism plate, as well as the supply of the force element with the respective working medium.

The prism plates may comprise narrow channels which connect the respective force element for the system via separately branching off lines to supply a fluid and may furthermore also be provided with a line that connects to a central power supply.

If the prism plates are supplied with a working medium for generating power via the central supply and with the aid of a control element, then all installed force elements may start up the feed elements which are operatively connected. The smooth end faces of the activated feed elements thus form a straight plane, which temporarily and/or intermittently disable the slanted surfaces of the prism plates. The individual prism plates can then be used for processing the flat book block backs as a result of the operational integration of the feed elements.

If the working medium is again shut down, the force element returns to its starting position and the feed elements return to the starting position, preferably owing to their inherent weight. The slanted surfaces of the prism plates then take over their usual function, such that books with rounded backs can be taken on once more.

BRIEF DESCRIPTION OF THE DRAWINGS

These and other features and advantages of the invention will be further understood from the following detailed description of embodiments with reference to the accompanying drawings. All elements not needed for a direct understanding have been omitted. The same elements in different Figures are given the same reference numbers, wherein.

DETAILED DESCRIPTION

Figure 1:
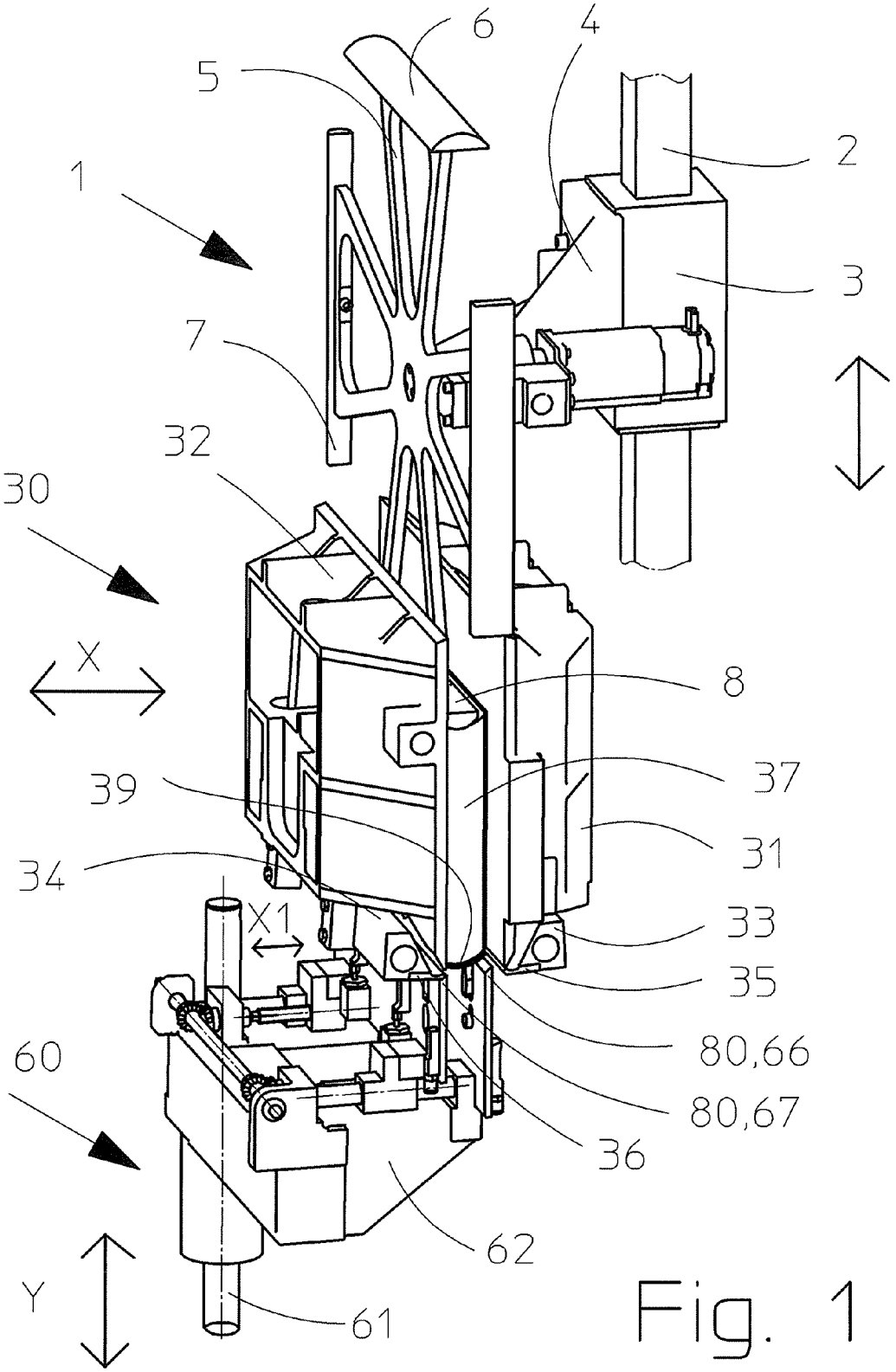
FIG. 1 shows a perspective representation of the book forming and pressing machine according to one exemplary embodiment, wherein the inserted book has a rounded back and the shaping and pressing machine comprises adjustable elements in a pointed position.
Figure 2:
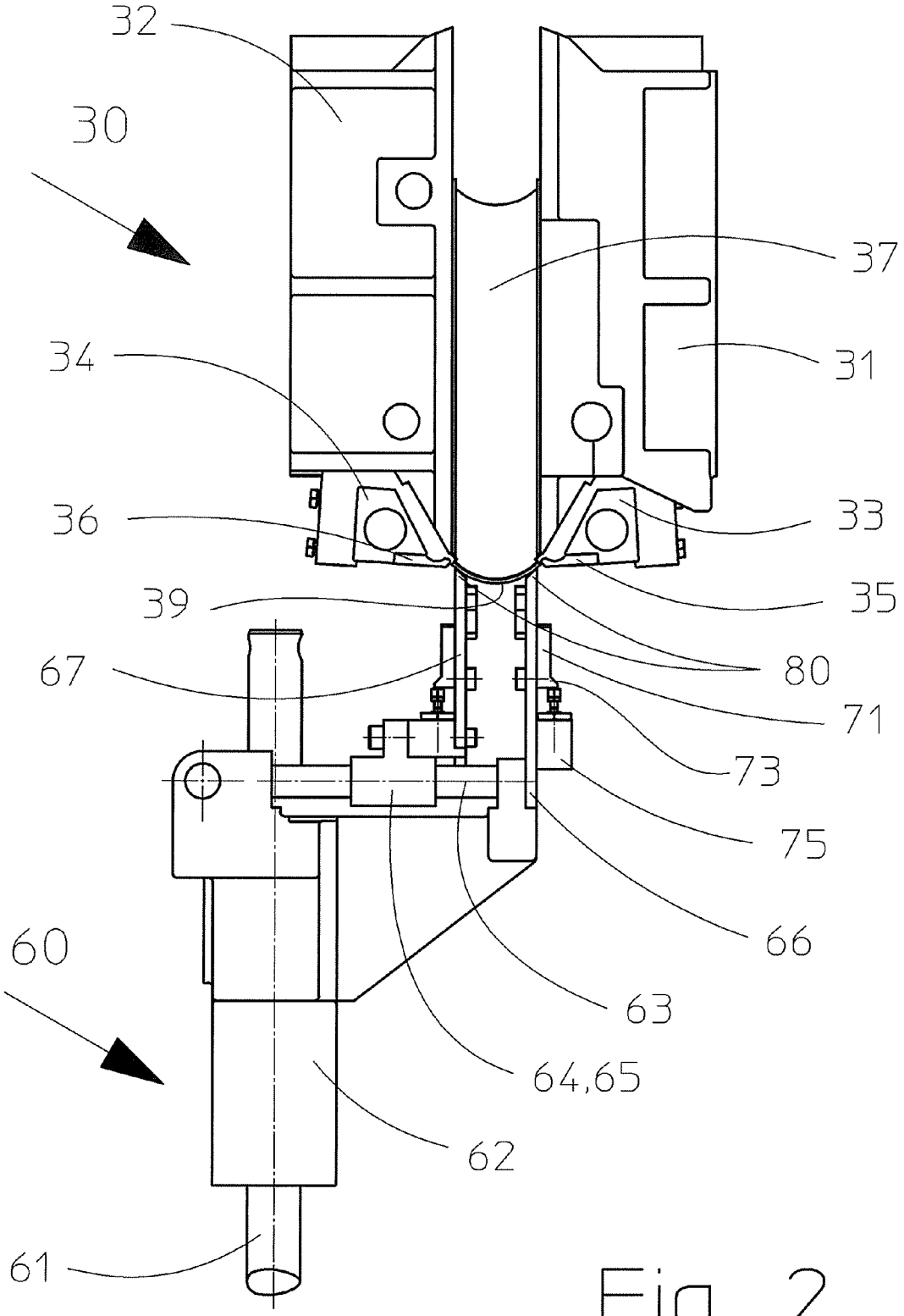
FIG. 2 shows a view from the side of the book forming and pressing machine according to FIG. 1, without a reshaping device.
Figure 3:
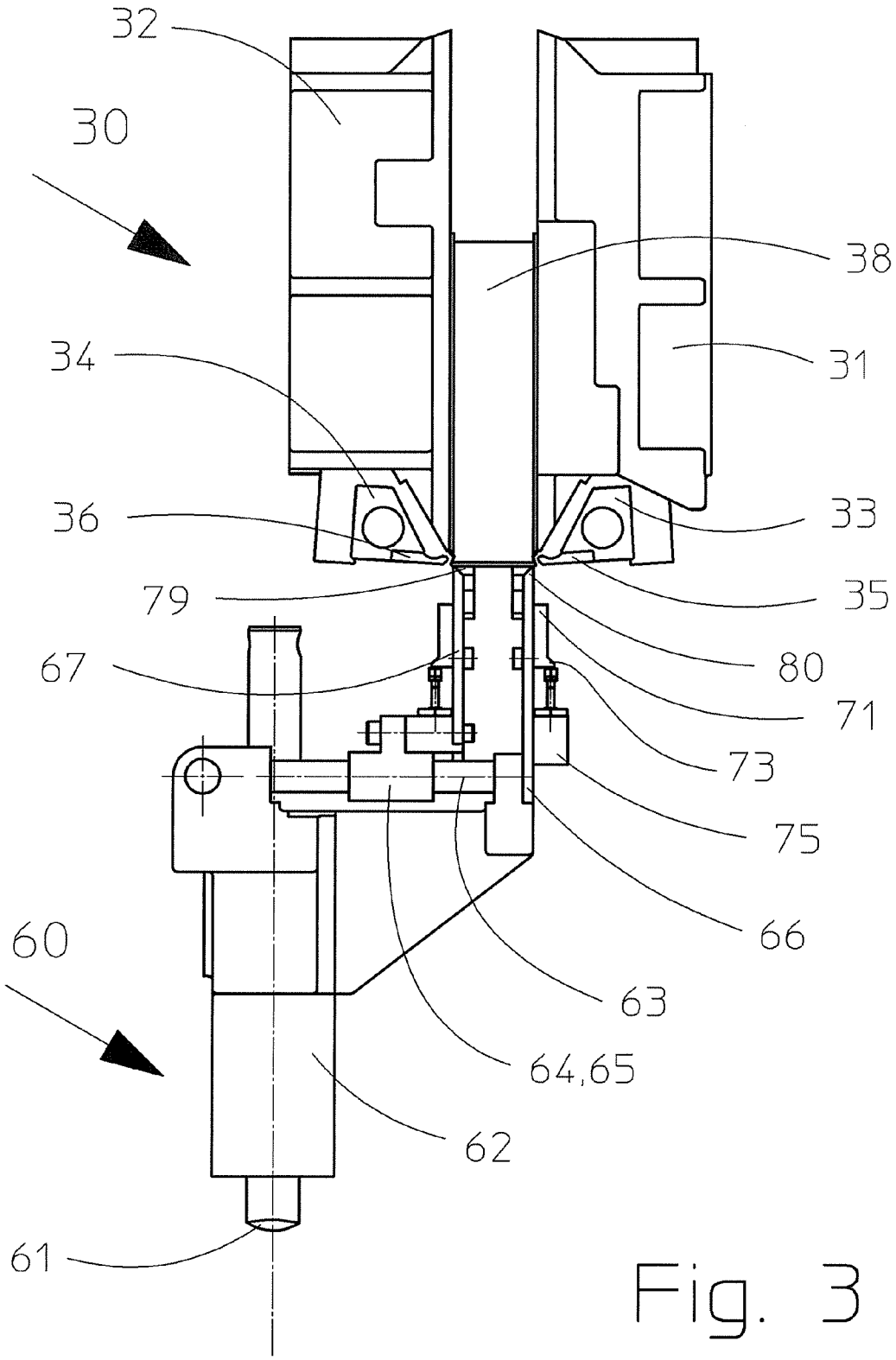
FIG. 3 shows a further view from the side that corresponds to the side view in FIG. 2 of the book forming and pressing machine according to FIG. 1, wherein the inserted book has a flat back and the shaping and pressing machine comprises adjustable elements in a flat position.

Referring to FIGS. 1-3, there is shown an embodiment of a book forming and pressing machine designed to hold a book block 37, 38 between two pressing plates 31, 32 on a loading table 62.

In FIG. 1, a book block 37 with rounded back can be seen which is clamped in between the pressing plates 31, 32. As a rule, the book forming and pressing machine as disclosed in FIGS. 1 to 3 is intended for a vertical orientation of the book blocks 37, 38. However, the vertical orientation of the forming and pressing machine shown herein is not absolutely required.

FIG. 1 shows in a view from the top to the bottom of a reshaping device 1, a pressing device 30 and a loading device 60. The loading device 60 comprises spaced-apart and parallel arranged prism plates 66, 67, as shown in FIG. 2.

To illustrate the installation situation and the function of the book forming and pressing machine, the reshaping device 1 is shown in FIG. 1 with a vertically adjustable and rotatable tool carrier 5 with shaping inserts or rails 6, 7, and 8. The reshaping device 1 and/or the infrastructure of the tool carrier 5 is configured essentially, but not absolutely, with a guide rod 2, a guide carriage 3 and a support arm 4, wherein the technical function of these components follows unambiguously from FIG. 1.

Referring to FIG. 2, the upper ends 80 of the prism plates 66, 67 face the book back 39 and have an edge that is beveled from the outside toward the inside and is furthermore also tilted toward the inside.

The thickness of the book corresponds to the measure for the spacing between the two prism plates 66, 67, including the thickness of the two prism plates, which simultaneously means that thicker books consequently rest only with the outer region of the book block back on the prism plates.

Case by case, tolerances are provided for the adjusted spacing between the two prism plates 66, 67 which tolerances are intended to ensure that the prism plates do not come into contact with the pressing plates 31, 32 during the book production.

If a pressing plate is installed locally fixed, it also serves to determine the position for a first locally fixed prism plate. FIGS. 1-3 show that the pressing plate 31 is locally fixed. The pressing plate 32, which is arranged parallel thereto and at a distance, can thus be adjusted to the respective book dimensions.

For this, the inner pressing plate 32 can be displaced crosswise to a longitudinal axis of the back and in particular horizontal (see FIG. 1; double arrow X1). In a lower region of the pressing device 30, heating bars 33, 34 that face the book block back 39 are arranged on both sides of the book block 37 (FIGS. 1 and 2) and 38 (FIG. 3) which operate heating rails 35, 36 that act upon the book block.

The prism plates 66, 67 thus support the respective book block 37, 38 at least line-shaped below the burn-in rails 35, 36. In the case of the rounded book block back 39, the support as a rule is not precisely line-shaped, but the support is realized via relatively small areas on the surface owing to a certain flexibility of the material for the book block back. Flat book block backs (see FIG. 3), on the other hand, are supported more or less over the complete surface by the prism plates used.

Figure 5:
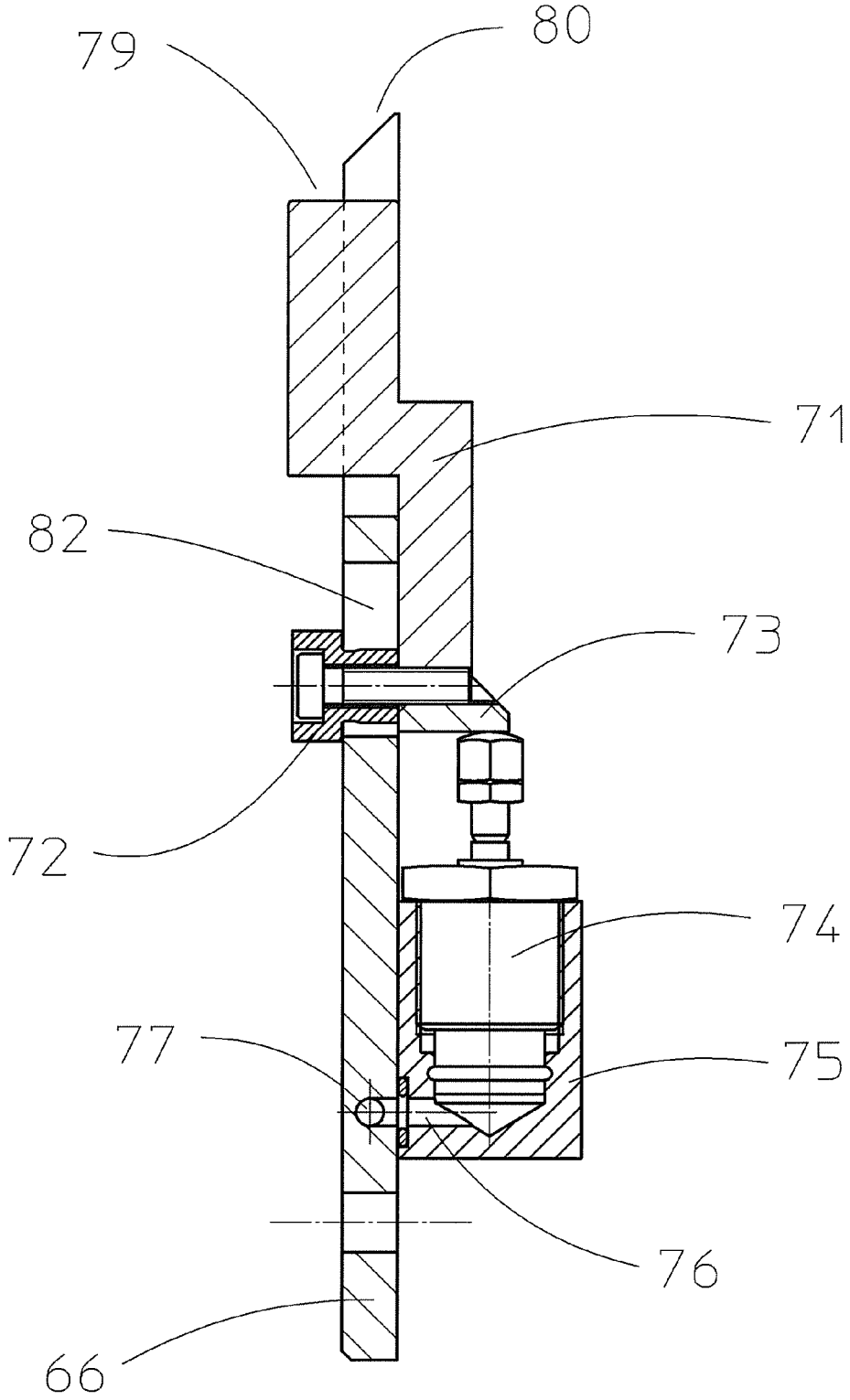
FIG. 5 shows a section through one of the prism plates shown in FIG. 4, with the adjustable elements in the pointed position.
Figure 6:
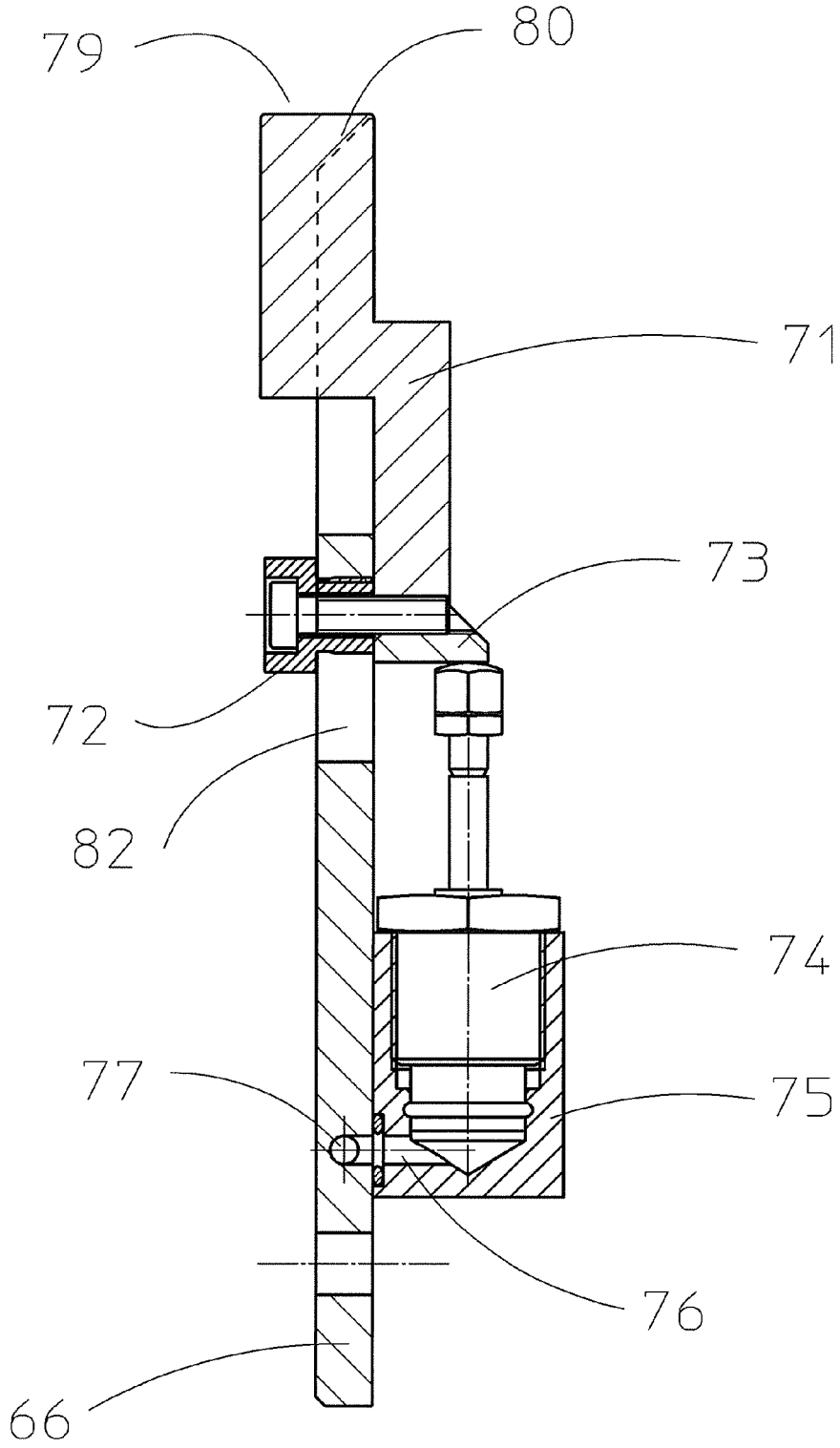
FIG. 6 shows a sectional view corresponding to FIG. 5 through the prism plate, shown in FIG. 4, with the adjustable elements in the flat position.

The prism plates 66, 67 which now meet the function of base plates are respectively provided with outside arranged feed elements 71 which can be adjusted in the vertical direction (see in particular FIGS. 5 and 6). Activation of the feed elements results in a superimposition in height of the base plates.

Figure 4:
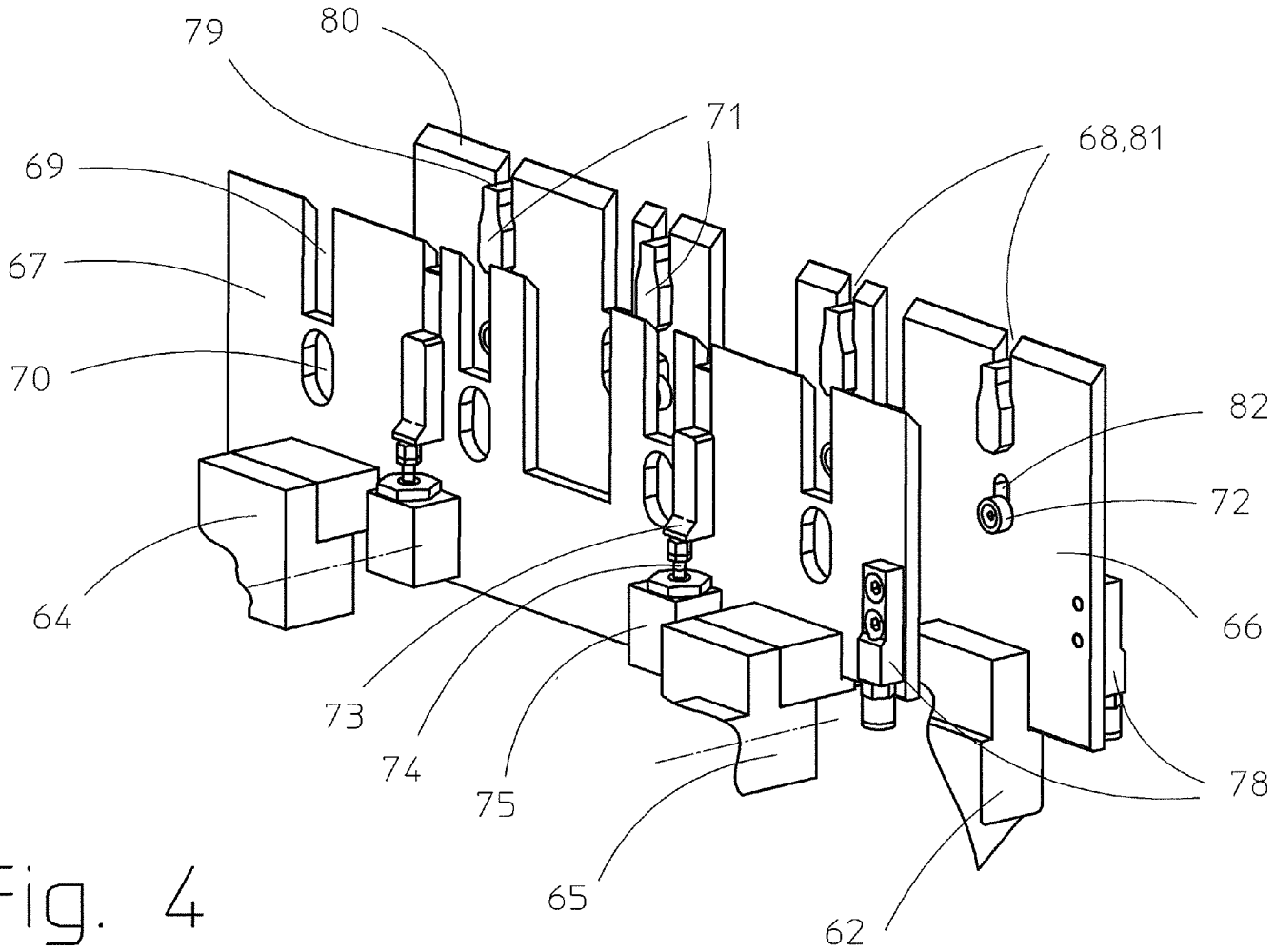
FIG. 4 shows a perspective representation of prism plates for the book forming and pressing machine as shown with the example in FIGS. 1 to 3, in a separate representation without a book.

To discuss FIG. 4 briefly, these feed elements 71 are provided regularly spaced apart over the complete length of the respective prism plate 66, 67, wherein an irregular distribution is also possible. These feed elements 71 consequently are operational in points along the length of the prism plates 66, 67 and are driven in the vertical direction by guide slot-type channels 68 which are intended for this. On the inside of the prism plates they are provided with projecting supports for supporting the respective book block back. Further explanations relating to FIG. 4 are provided in connection with the description of FIGS. 5 and 6.

Analogous to the adjustment of the pressing plates in the horizontal direction to match the thickness of the book (see FIG. 1; double arrow X1), an adjustment X of the one prism plate 67, relative to the fixedly installed prism plate 66, is intended in this case as well, wherein it is also possible to embody both prism plates such that they adjust automatically.

The adjustment of the one prism plate 67 to achieve the necessary spacing in relation to the other prism plate 66 occurs via a loading table 62 which also supports the prism plates 66, 67, wherein the loading table forms a component of a loading device 60 (FIG. 1). This loading device is provided with a mechanism for the vertical advancing Y of the prism plates toward the book block back along the guide rod 61 and, by way of a carriage system 63, 64, 65, the horizontal advancing X of the prism plates, so as to match the book thickness.

In FIGS. 1, 2, 3, 4 and 5, the feed elements 71 are all retracted, meaning they are not in use.

A detailed representation of the prism plates 66, 67 is shown in FIGS. 4 to 6.

The prism plates 66, 67 are provided (FIG. 5 and visible only with dashes in FIG. 6) with guide channels 68, embodied as slots that open toward the upper ends 80, inside of which the adjustable feed elements 71 can be moved. That is to say, the feed elements 71 execute a vertical movement relative to the prism plates 66, 67 which function as base plates as a result of a switching operation.

The guide channels 68 are therefore embodied as slots and/or grooves 81 which extend in a lengthwise direction completely through the respective prism plate 66, meaning the feed elements 71 project on the inside from the prism plate 66. At the corresponding location, the opposite-arranged prism plate 67 is provided with recesses 69 for the respectively adjustable feed element 71. With this prism plate 67, the recesses 69 are also oriented in the same direction and embodied in the same way as for the opposite arrange prism plate 66.

A vertically oriented or quasi-vertically oriented guide channel 82 is respectively arranged below each guide channel 68 and is operatively connected to a clamping disc 72 which functions as safety element for the adjustable feed element 71 and, at the same time, ensures that the feed element remains displaceable in vertical direction along the inside surface of the respective prism plate 66, 67.

The clamping disc 72 is accordingly connected mechanically to the adjustable feed element 71, so that the cooperation between the clamping disc 72 and the guide channel 82 delimits the vertical movability of the adjustable elements 71.

The opposite arranged prism plate is provided with recesses 70, at the opposite location, so as to prevent that the vertical movement of the clamping discs 72 is blocked or prevented in case a minimum distance between the prism plates 66, 67 must be adjusted. These recesses are sufficiently large to ensure the functionality of the feed elements even if the prism plate spacing tends toward zero.

The inserted feed element 71 furthermore comprises an anvil 73 that is effective toward the outside and, with the aid of a switchable control element embodied as a lifting cylinder 74 herein, functions to forcefully push the feed element in one direction, here toward the top, as can be seen from the end position according to FIG. 6. The lifting cylinder is operated pneumatically or hydraulically after being admitted briefly with a working medium. Once the return stroke of the lifting cylinder 74 is initiated, this feed element 71 again returns to the starting position due to its inherent weight. The return movement is guided by a double-acting lifting cylinder. The lifting cylinder 74 is installed inside a bearing block 75 which takes over the mechanical connection between the lifting cylinder and the respective prism plate 66, 67 and also ensures the supply of the lifting cylinder 74 with the associated working medium.

Thin air channels 77 extend through the prism plates 66, 67 which connect the respective lifting cylinders of the system via separately branching-off lines 76. In addition, a line is provided for the connection to the central pneumatic or hydraulic supply 78.

If the prism plates 66, 67 are supplied with working medium via the central supply 78 and a control element, in this case an electrically switchable valve, then all installed lifting cylinders 74 start up their operatively connected feed elements 71. The smooth end faces of these feed elements 71 thus form a flat support surface 79, relative to the book block back (see FIG. 6), for a book with a flat back. According to FIG. 4, these feed elements 71 are composed of 6 individual surfaces which temporarily and/or intermittently disable the slanted surfaces 80 of the prism plates 66, 67, used for a rounded book back. The individual prism plates 66, 67 together with the feed elements 71 can then be used for flat book block backs.

Once the working medium is shut down, the lifting cylinders are retracted and the elements drop back to the starting position, preferably as a result of their inherent weight. The slanted surfaces of the prism plates 66, 67 again become functional and can thus accommodate books with a rounded back.

It will be understood that the above description of the present invention is susceptible to various modifications, changes and adaptations, and the same are intended to be comprehended within the meaning and range of equivalents of the appended claims.

What is claimed is:

1. A book forming and pressing machine, comprising:

a reshaping device to perform a shaping operation on a book block;

a pressing device comprising a number of spaced-apart pressing plates and burn-in rails to press the book block during the shaping operation;

a loading device comprising a loading table, the loading table including a book block back support arrangement to support the book block back during the shaping operation, the book block back support arrangement including:

at least one pair of prism plates having shaped upper edges and arranged spaced-apart, extending parallel or quasi-parallel to each other to support a correspondingly shaped book block back during the shaping operation; and at least one feed element operatively connected with each prism plate and arranged on the inside of the prism plates, the feed elements each having an upper surface shaped differently from the shaped upper edge of the prism plate to which the feed element is connected and being adjustable to a position above the shaped upper edge of the prism plate to which the prism plate is connected, wherein the feed elements in said position will support a correspondingly differently shaped book block back in place of the shaped upper edges of the prism plates.

2. The book forming and pressing machine according claim 1, wherein the book block back support arrangement includes a control element to transmit a translational vertical or quasi-vertical movement to the at least one feed element outside of the prism plates to adjust the height of the feed element on the inside of the prism plates.

3. The book forming and pressing machine according to claim 2, wherein the control element is one of a mechanical, pneumatic or hydraulic mechanism, or a servo motor.

4. The book forming and pressing machine according to claim 2, wherein the control element comprises a fluid-operated lifting cylinder.

5. The book forming and pressing machine according to claim 4, wherein at least one of the prism plates comprises channels for a fluid medium.

6. The book forming and pressing machine according to claim 1, wherein the height of the at least one feed element is adjustable to at least the upper edge of the respective prism plate.

7. The book forming and pressing machine according to claim 1, wherein the prism plates are narrow, elongated bars.

8. The book forming and pressing machine according to claim 1, wherein a gap between the prism plates can be reduced up to a zero value.

9. The book forming and pressing machine according claim 1, wherein the prism plates and the at least one feed element have upper support surfaces that are operatively adapted to the respective shape of the book block back.

10. The book forming and pressing machine according to claim 9, wherein the prism plates have upper support surfaces comprising chamfered edges extending toward an inside of the prism plates to accommodate a rounded book block back.

11. The book forming and pressing machine according to claim 9, wherein the upper support surface of the feed element is a flat or quasi-flat surface for a flat book block back.

12. The book forming and pressing machine according to claim 1, further comprising a safety element coupled with the at least one feed element to delimit a distance in movement of the at least one feed element.

13. A book forming and pressing machine, comprising:

a reshaping device to perform a shaping operation on a book block;

a pressing device comprising a number of spaced-apart pressing plates and burn-in rails to press the book block during the shaping operation;

a loading device comprising a loading table, the loading table including a book block back support arrangement to support the book block back during the shaping operation, the book block back support arrangement including:

at least one pair of prism plates having shaped upper edges and arranged spaced-apart, extending parallel or quasi-parallel to each other to support a correspondingly shaped book block back during the shaping operation; and at least one feed element operatively connected with each prism plate and adjustable to a position to support a differently shaped book block back in place of the shaped upper edges of the prism plates, wherein the at least one feed element includes a plurality of feed elements arranged along a length of each prism plate.

14. The book forming and pressing machine according to claim 13, wherein the prism plates comprise a number of guide channels that correspond to the plurality of feed elements arranged thereon.

15. The book forming and pressing machine according to claim 13, wherein the feed elements on the opposite-arranged prism plates are arranged offset to each other.

16. The book forming and pressing machine according to claim 15, wherein at least one of the prism plates includes recesses arranged opposite the feed elements of the other prism plate to ensure free movement of the feed elements.

17. A book production line including the book forming and pressing machine according to claim 1.

18. A method of re-shaping the book block back comprising utilizing a book forming and pressing machine according to claim 1.

* * * * *